US005704770A

United States Patent [19]

Cunkelman

[11] Patent Number: 5,704,770

[45] Date of Patent: Jan. 6, 1998

[54] AIR PASSAGE INSERT FOR OIL FILL SPOUT

[75] Inventor: Brian Cunkelman, Wilmerding, Pa.

[73] Assignee: Westinghouse Air Brake Company, Wilmerding, Pa.

[21] Appl. No.: 304,265

[22] Filed: Sep. 12, 1994

[51] Int. Cl.[6] ..... F04B 39/02

[52] U.S. Cl. ..... 417/313; 184/6.5; 123/198 DA; 123/196 CP; 123/198 P

[58] Field of Search ..... 184/6.5; 92/147; 123/195 C, 198 DA, 196 CP, 198 P; 417/313

[56] References Cited

U.S. PATENT DOCUMENTS

| | | | |
|---|---|---|---|
| 1,278,655 | 10/1918 | Holliday | 123/196 CP |
| 1,408,179 | 2/1922 | DuPont | 184/6.5 |
| 1,520,390 | 12/1924 | Carpenter | 123/196 CP |
| 2,064,070 | 12/1936 | Mapes et al. | 417/313 |
| 2,150,487 | 3/1939 | Brown | 184/6.5 |
| 2,598,147 | 5/1952 | Tescher | 123/196 CP |
| 4,589,376 | 5/1986 | Albertson | 123/25 R |
| 5,080,082 | 1/1992 | Mueller et al. | 123/574 |
| 5,335,641 | 8/1994 | Schnabel | 123/574 |

OTHER PUBLICATIONS

Instructions for Disassembly, Repair and Assembly of "3-CD" Air Compressors, Mar., 1994.

*Primary Examiner*—Charles G. Freay
*Assistant Examiner*—Peter G. Korytnyk
*Attorney, Agent, or Firm*—James Ray & Associates

[57] ABSTRACT

An air passage insert for an oil fill spout disposed on a side of an oil crankcase which includes an air communication passageway having a first end thereof disposed within an interior portion of such oil crankcase at a position above an oil full level and a second end thereof being in communication with atmosphere for communicating air from such interior portion of such oil crankcase in a space located above such oil full level. There is an further provided an attachment device which is engageable with both such air communication passageway and such oil fill spout for attaching the air communication passageway at least to one of such oil fill spout and such interior portion of such oil crankcase thereby enabling air to be vented from such space located above such oil fill level during an oil filling process.

18 Claims, 3 Drawing Sheets

AIR PASSAGE INSERT FOR OIL FILL SPOUT

FIELD OF THE INVENTION

The present invention relates, in general, to oil fill spouts which communicate oil to crankcases and, more particularly, this invention relates to an air passage insert for use with an oil fill spout, specifically, an oil fill spout disposed on a crankcase of an air compressor.

BACKGROUND OF THE INVENTION

As is generally well known in the art, oil fill spouts are provided to communicate oil to a crankcase and have been in use for many years prior to the present invention. In a number of cases, these oil fill spouts are located on the side of the crankcase at a position which is located below the desired level of the oil. One example of this particular type oil fill spout is the oil fill spout disposed on the side of a crankcase on an air compressor. An industrial type air compressor having an oil fill spout of this type, for example, is a 3CD type air compressor manufactured by Westinghouse Airbrake Company, the assignee of the present invention.

When filling the crankcase of this 3CD type industrial air compressor with oil it has been found that once the oil level rises above the uppermost portion of the oil fill spout air becomes trapped in the crankcase in the space located above such uppermost portion of the oil fill spout. This undesirable situation normally causes the oil filling process to proceed at an unacceptably slow rate. The reason for this slow rate is because it is necessary for the trapped air to leak out of such crankcase past the compression rings, valves and breather. It is not uncommon, for example, for the oil filling process to require a period of time which may extend for as long as twenty minutes to complete. Furthermore, because these 3CD type air compressors are being operated on a substantially continuous basis they normally use a considerable amount of oil and require frequent refilling.

SUMMARY OF THE INVENTION

The present invention provides an air passage insert for an oil fill spout disposed on a side of an oil crankcase. Such air passage insert includes an air communication means having a first end thereof disposed at a predetermined location within the interior portion of such oil crankcase at a position above an oil full level. The second end of such air communication means is positioned in communication with the atmosphere for communicating air from such interior portion of such oil crankcase in a space located above such oil full level. Additionally, there is an attachment means provided which is engageable with both such air communication means and such oil fill spout for attaching the air communication means at least to one of such oil fill spout and such interior portion of such oil crankcase and thereby enabling air to be vented from such space located above such oil fill level during an oil filling process.

OBJECTS OF THE INVENTION

It is, therefore, one of the primary objects of the present invention to provide an apparatus which will permit the filling of an oil crankcase in substantially less time, particularly, an oil crankcase disposed on an air compressor.

Another object of the present invention is to provide an apparatus to communicate air from an oil crankcase during an oil filling process which is relatively simple.

Still another object of the present invention is to provide an apparatus to communicate air from an oil crankcase during an oil filling process which is relatively inexpensive to manufacture.

A still further object of the present invention is to provide an apparatus for communicating air from an oil crankcase which can be rather easily and readily retrofitted into an existing oil crankcase, particularly, an oil crankcase disposed on an air compressor.

Yet another object of the present invention is to provide an apparatus for communicating air from an oil crankcase which can be attached to the oil fill spout disposed on the side of the crankcase in a number of different configurations.

In addition to the various objects and advantages of the air passage insert for an oil fill spout described above, various additional objects and advantages of the present invention will become more readily apparent to those persons who are skilled in the relevant art from the following more detail description of such invention, particularly, when such detailed description is taken in conjunction with both the attached drawing figures and the appended claims.

Figure 1:
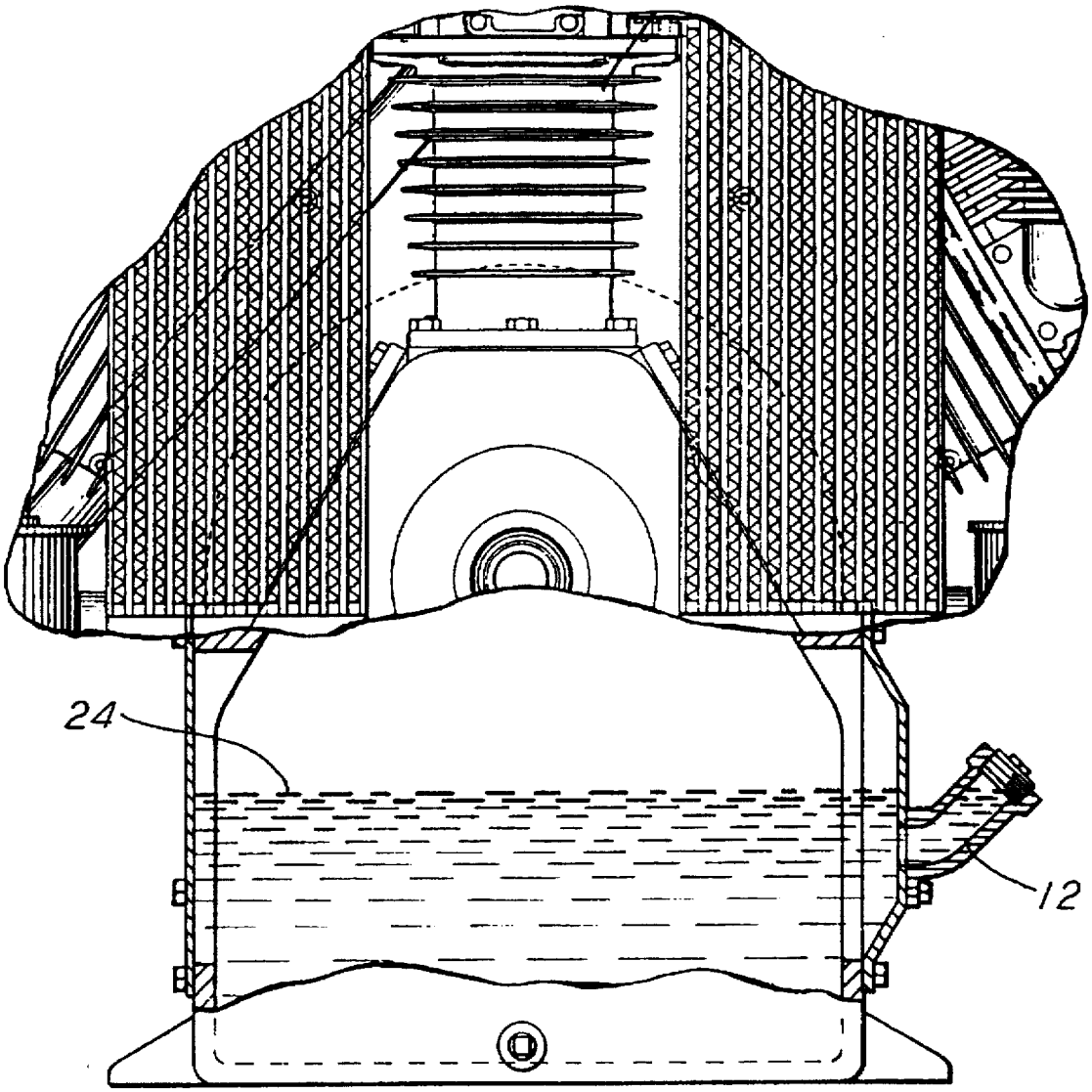
FIG. 1 PRIOR ART
FIG. 1 is a side elevation view which illustrates an air compressor having a prior art type oil fill spout disposed on the side of the oil crankcase.

BRIEF DESCRIPTION OF PRESENTLY PREFERRED AND ALTERNATIVE EMBODIMENTS OF THE INVENTION

Prior to proceeding to the more detailed description of the instant invention it should be noted that, for the sake of clarity, identical components, which have identical functions, have been identified with identical reference numerals throughout the drawing figures.

Figure 2:
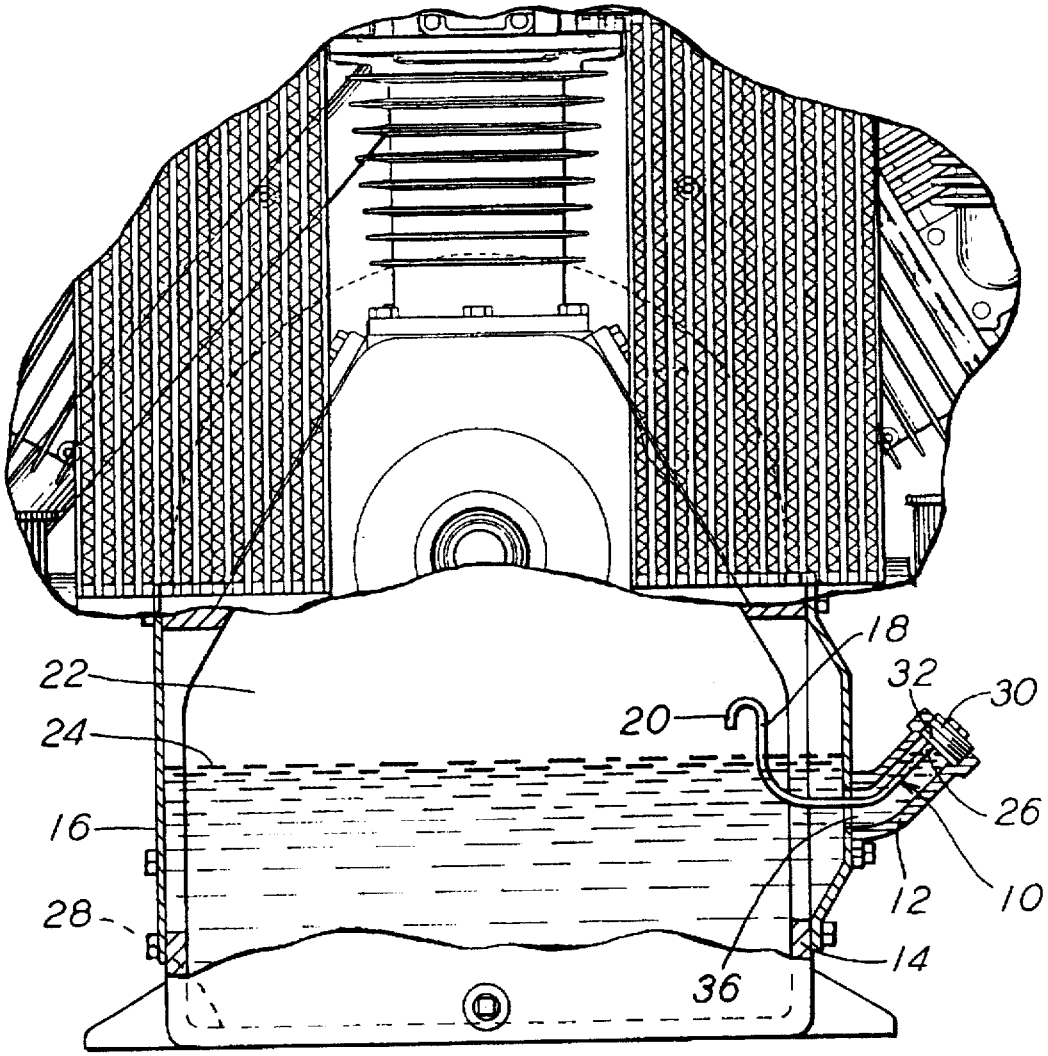
FIG. 2 is a side elevation view which illustrates an air compressor oil fill spout disposed on the side of the oil crankcase that includes a presently preferred embodiment of the invention incorporated therein.
Figure 3:
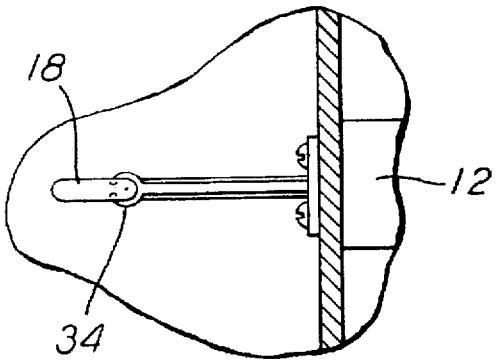
FIG. 3 is a top view which illustrates an air compressor oil fill spout disposed on the side of the oil crankcase that includes an additional alternative attachment means for the air passage insert incorporated therein.

Now particular attention is directed to FIGS. 1 through 3. Illustrated therein are the presently preferred embodiments of an air passage insert, generally designated 10, for an oil filling spout 12 disposed on a side 14 of an oil crankcase 16.

The air passage insert 10, of the present invention includes an air communication means 18 having a first end 20 thereof disposed within an interior portion 22 of such oil crankcase 16 at a position above an oil full level 24. The second end 26 of such air communication means 18 is disposed in communication with the atmosphere for communicating air from such interior portion 22 of the oil crankcase 16 that would otherwise be trapped in the space located above such oil full level 24.

The air insert passage 10, of the instant invention, further includes an attachment means, generally designated 30, engageable with each of such air communication means 18 and such oil fill spout 12 for attaching such air communication means 18 at least to one of such oil fill spout 12 and such interior portion 22 of such oil crankcase 16 thereby enabling air to be vented from such space located above such oil fill level 24 during an oil filling process.

According to the presently preferred embodiment of the invention, such air communication means 18 is a tube like member which exhibits a predetermined configuration. In this embodiment, such predetermined configuration of the tube like member is such that at least such first end 20 thereof is disposed substantially facing a bottom surface 28 of such oil crankcase 16. Additionally, such tube like member will be formed from at least one of metal and plastic. Preferably, such tube like member will be formed from metal.

As can be best seen in FIG. 2, in the presently preferred embodiment of the invention, such attachment means 30 includes at least one washer like member 32 which is engageable at a predetermined position in such oil fill spout 12. As is evident in FIG. 2 the second end 26 of such tube like air communication means 18 is secured to such washer like member 32.

Figure 4:
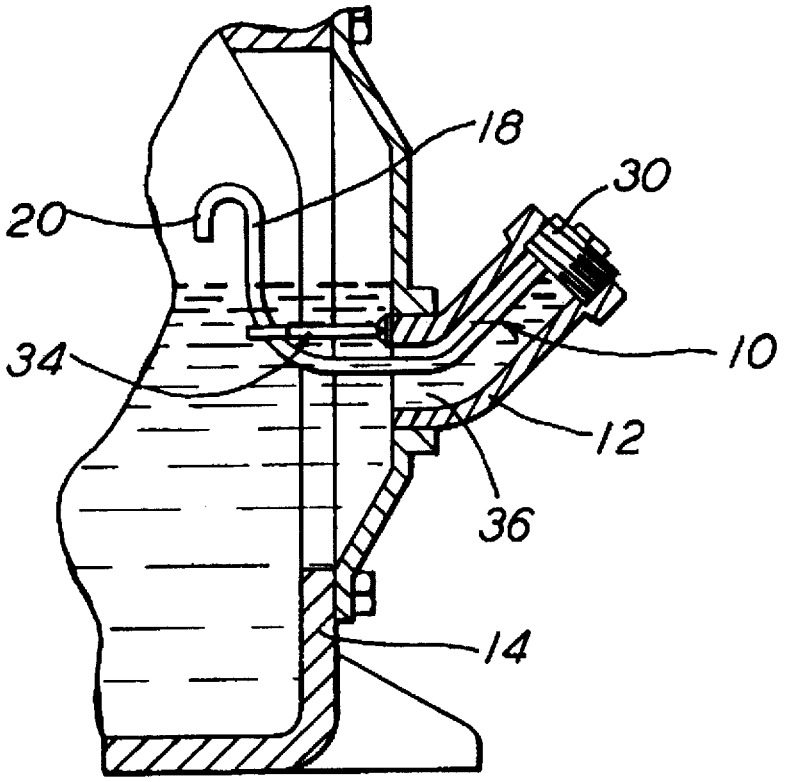
FIG. 4 is a side view which illustrates an air compressor oil fill spout disposed on the side of the oil crankcase that includes a third alternative attachment means for the air passage incorporated therein.

Illustrated in FIG. 3 is an alternative embodiment of such attachment means 30 that includes at least one clamp member 34 which is engagable with such air communication means 18 and with at least one of such interior portion 22 of such oil crankcase 16 (FIG 3). As another alternative, such attachment means 30 can be attached to an interior portion 36 of such oil fill spout 12 (FIG 4).

It should be evident from the above description that such attachment means 30 includes a combination of at least one washer like member 32 being engageable at a predetermined position in such oil fill spout 12 and having such second end 26 of such tube like air communication means 18 secured thereto and at least one clamp member 34 being engagable with the tube like air communication means 18 and with such interior portion 22 of the oil crankcase 16.

The air passage insert 10 for an oil fill spout 12, of the present invention, is particularly useful for an oil crankcase 16 that is disposed on an air compressor (not shown) and more particularly when such air compressor is an industrial type air compressor. Still more particularly the air passage insert 10 for an oil fill spout 12, of the present invention, is useful for an oil crankcase 16 that is disposed on an air compressor that is a 3CD type air compressor disposed on a railway locomotive.

While a number of presently preferred and various alternative embodiments of the air passage insert for an oil fill spout have been described in detail above it should be understood that those persons who are skilled in the art can envision various other modifications and adaptations of the invention without departing from either the spirit or scope of the appended claims.

I claim:

1. In an air compressor having an oil crankcase with an oil fill spout disposed on a side of such oil crankcase, the improvement comprising an air passage insert comprising:

(a) an air communication means having a first end thereof disposed within an interior portion of said oil crankcase at a position above an oil full level and a second end thereof being in communication with the atmosphere outside of the crankcase for communicating air from the interior portion of said oil crankcase in a space located above such oil full level to the outside atmosphere; and (b) an attachment means engageable with both said air communication means and said oil fill spout for attaching said air communication means at least to one of said oil fill spout and the interior portion of said oil crankcase thereby enabling air to be vented to the outside atmosphere from the space located above such oil fill level during an oil filling process.

2. An air compressor, according to claim 1, wherein said air compressor is an industrial type air compressor.

3. An air compressor, according to claim 2, wherein said air communication means is a tube like member having a predetermined configuration.

4. An air compressor, according to claim 3, wherein said predetermined configuration of said tube like member is such that at least said first end thereof is disposed substantially facing a bottom surface of said oil crankcase.

5. An air compressor, according to claim 4, wherein said tube like member is formed from metal.

6. An air compressor, according to claim 2, wherein said attachment means includes at least one washer like member engageable at a predetermined position in said oil fill spout and having said second end of said air communication means secured thereto.

7. An air compressor, according to claim 2, wherein said attachment means includes at least one clamp member engagable with said air communication means and with at least one of said interior portion of said oil crankcase and an interior portion of said oil fill spout.

8. An air compressor, according to claim 2, wherein said attachment means includes at least one washer like member engageable at a predetermined position in said oil fill spout and having said second end of said air communication means secured thereto and at least one clamp member engagable with said air communication means and with said interior portion of said oil crankcase.

9. An air compressor, according to claim 2, wherein said industrial type air compressor is a 3CD type air compressor disposed on a railway locomotive.

10. An air passage insert for an oil fill spout disposed on a side of an oil crankcase, said air passage insert comprising:

(a) an air communication means having a first end thereof disposed within an interior portion of such oil crankcase at a position above an oil full level and a second end thereof being in communication with the atmosphere outside of the crankcase for communicating air from such interior portion of the oil crankcase in a space located above such oil full level to the outside atmosphere; and (b) an attachment means engageable with both said air communication means and such oil fill spout for attaching said air communication means at least to one of such oil fill spout and the interior portion of such oil crankcase thereby enabling air to be vented from the space located above such oil fill level during an oil filling.

11. An air passage insert for an oil fill spout, according to claim 10, wherein said air communication means is a tube like member having a predetermined configuration.

12. An air passage insert for an oil fill spout, according to claim 11, wherein said predetermined configuration of said tube like member is such that at least said first end thereof is disposed substantially facing a bottom surface of such oil crankcase.

13. An air passage insert for an oil fill spout, according to claim 12, wherein said tube like member is formed from metal.

14. An air passage insert for an oil fill spout, according to claim 10, wherein said attachment means includes at least one washer like member engageable at a predetermined position in such oil fill spout and having said second end of said air communication means secured thereto.

15. An air passage insert for an oil fill spout, according to claim 10, wherein said attachment means includes at least one clamp member engagable with said air communication means and with at least one of such interior portion of such oil crankcase and an interior portion of such oil fill spout.

16. An air passage insert for an oil fill spout, according to claim 10, wherein said attachment means includes at least one washer like member engageable at a predetermined position in such oil fill spout and having said second end of said air communication means secured thereto and at least one clamp member engagable with said air communication means and with such interior portion of such oil crankcase.

17. An air passage insert for an oil fill spout, according to claim 10, wherein said oil crankcase is disposed on an air compressor.

18. An air passage insert for an oil fill spout, according to claim 10, wherein said air compressor is an industrial type air compressor.

* * * * *

UNITED STATES PATENT AND TRADEMARK OFFICE

CERTIFICATE OF CORRECTION

PATENT NO. : 5,704,770

DATED : January 6, 1998

INVENTOR(S) : Brian Cunkelman

It is certified that error appears in the above-identified patent and that said Letters Patent is hereby corrected as shown below:

Column 2, line 18, after "more", please delete "detail" and insert --detailed--.

Signed and Sealed this

Second Day of May, 2000

*Attest:*

*Attesting Officer*

Q. TODD DICKINSON

*Director of Patents and Trademarks*